United States Patent [19]

Barringer

[11] Patent Number: 4,460,102

[45] Date of Patent: Jul. 17, 1984

[54] SEALED CONTAINER

[76] Inventor: Albert J. Barringer, 2678 Ehrhart Dr., Springfield, Ohio 45502

[21] Appl. No.: 422,426

[22] Filed: Sep. 23, 1982

[51] Int. Cl.[3] ..... B65D 25/04; B65D 90/32

[52] U.S. Cl. ..... 220/85 B; 220/22

[58] Field of Search ..... 220/20, 22, 85 B

[56] References Cited

U.S. PATENT DOCUMENTS

| | | | |
|---|---|---|---|
| 1,233,028 | 7/1917 | Clifton et al. | 220/203 |
| 1,652,793 | 12/1927 | Perry | 220/85 B |
| 1,666,666 | 4/1928 | Pew, Jr. | 220/85 |
| 2,001,873 | 5/1935 | Hansson | 220/85 B |
| 2,254,557 | 9/1941 | Wittenberg | 53/2 |
| 2,273,505 | 2/1942 | Florian | 138/28 |
| 2,405,614 | 4/1946 | Shriro | 220/85 B |
| 2,421,700 | 6/1947 | Johnson | 220/85 B |
| 2,509,075 | 5/1950 | Richeson et al. | 220/57 |
| 2,643,602 | 6/1953 | Martin | 99/235 |
| 2,912,138 | 10/1959 | Bishop | 220/85 B |
| 2,964,214 | 12/1960 | Stannard | 220/44 |
| 3,173,265 | 3/1965 | Bixby | 220/85 B |
| 3,627,171 | 12/1971 | Kaplow et al. | 220/85 B |
| 4,177,844 | 12/1979 | Kuss et al. | 150/1 |
| 4,376,489 | 3/1983 | Clemens | 220/85 B |

*Primary Examiner*—George E. Lowrance

*Attorney, Agent, or Firm*—Donald J. Singer; Charles E. Bricker

[57] ABSTRACT

A shipping and storage container comprising a containing portion defining a containing chamber, a lid defining a second chamber, and an expansible/contractable member positioned between the containing portion and the lid. The expansible/contractable member allows expansion/contraction of the atmosphere within the containing chamber.

5 Claims, 8 Drawing Figures

SEALED CONTAINER

RIGHTS OF THE GOVERNMENT

There is reserved to the Government of the United States a nonexclusive, irrevocable, royalty-free license in the invention described herein with power to grant licenses for all governmental purposes.

BACKGROUND OF THE INVENTION

This invention relates to shipping and storage containers.

Shipping and storage containers generally must provide for the physical security of items being shipped or stored. Additionally, certain items must be protected against corrosion or other forms of deterioration, and certain other items must be completely segregated from the surrounding atmosphere. While containers may be hermetically sealed, seals have been known to fail, thus allowing egress of the container atmosphere and ingress of the atmosphere surrounding the container. Where it is desired to maintain a low level of humidity within the container, a dessicant may be employed to absorb excess moisture; however, should the dessicant become saturated, it must be replaced with dry dessicant. Failure to replace the dessicant could result in damage to the item contained therein.

Hermetically sealable containers are often impractical, either because of cost or physical size. In order to allow for changes in pressure and temperature, automatic pressure relief (APR) valves have been incorporated into shipping and storage containers. Though useful for most items and where the dessicant condition can be monitored, containers having APR valves cannot be used for dangerous materials which might emit hazardous vapors or the like.

What is desired is a shipping and storage container which is lightweight, which hermetically seals the item contained therein, and which allows expansion and contraction of the sealed atmosphere.

Accordingly, it is an object of the present invention to provide a shipping and storage container which is lightweight, which hermetically seals the containing portion and which allows expansion and contraction of the sealed portion.

Other objects and advantages of the present invention will become apparent to those skilled in the art.

DESCRIPTION OF THE PREFERRED EMBODIMENTS

Figure 2:
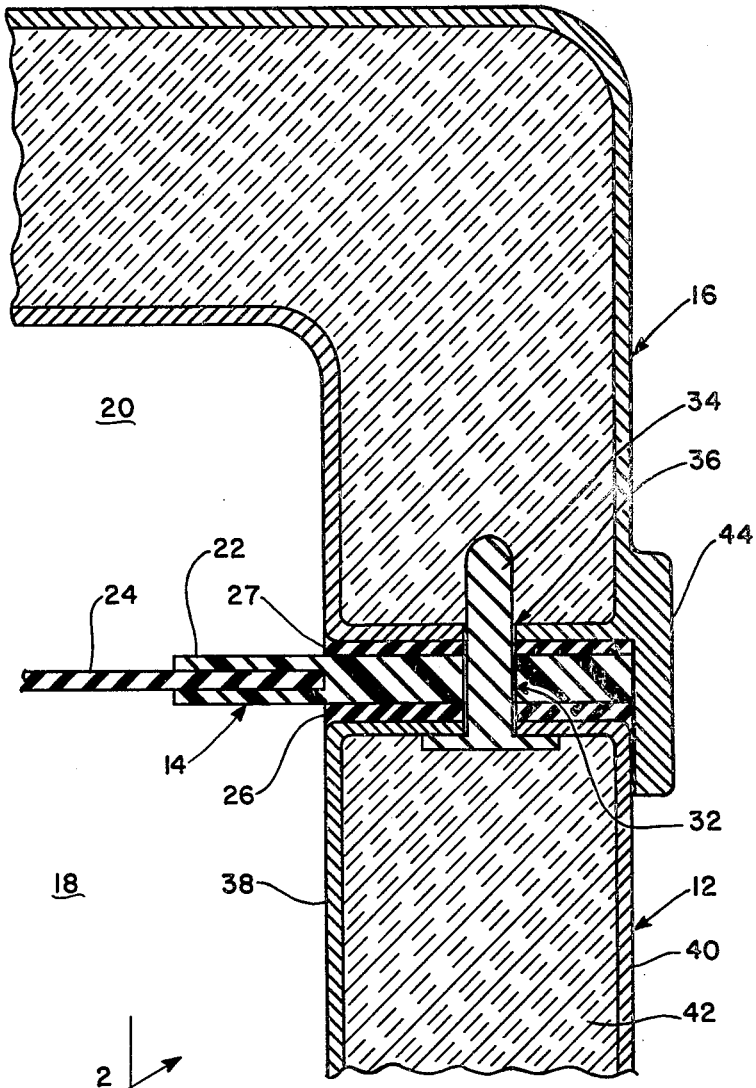
FIG. 2 is a section through 2—2 of FIG. 1.
Figure 1:
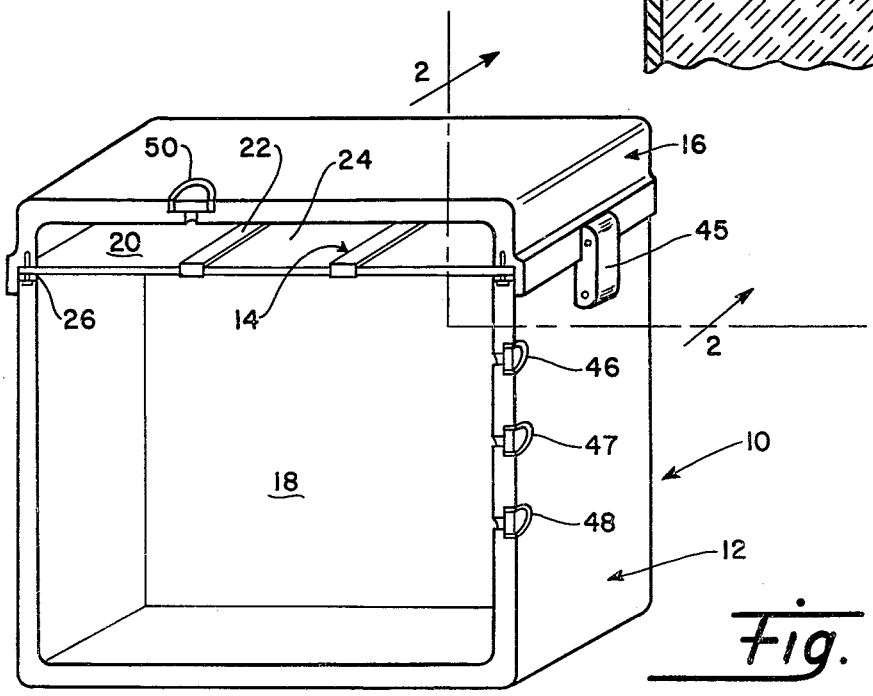
FIG. 1 is a sectional perspective view of the shipping and storage container of this invention which incorporates an internal expansible/contractable member.

Referring to FIGS. 1 and 2, the shipping and storage container of this invention, designated generally by the reference numeral 10, comprises a containing portion or box 12, a first closure 14 and a second closure 16. The first closure 14 divides the interior of container 10 into a first chamber 18 adapted for containing at least one item, and a second chamber 20.

Figure 3:
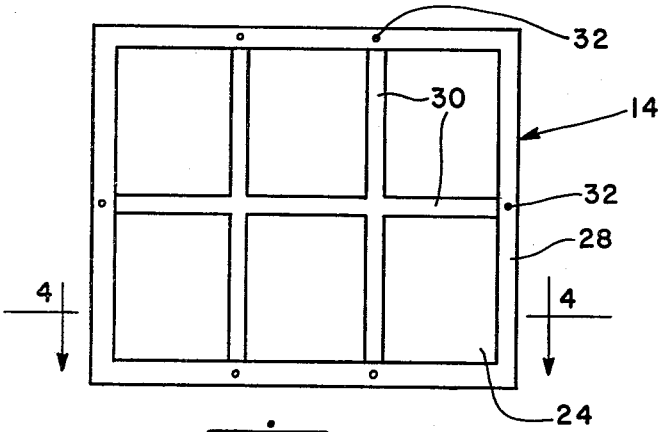
FIGS. 3, 5 and 7 are top plan views of expansible/-contractable members.
Figure 4:
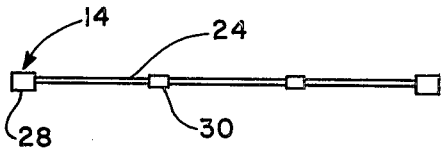
FIGS. 4, 6 and 8 are sections through 4—4, 6—6 and 8—8 of FIGS. 3, 5 and 7, respectively.
Figure 5:
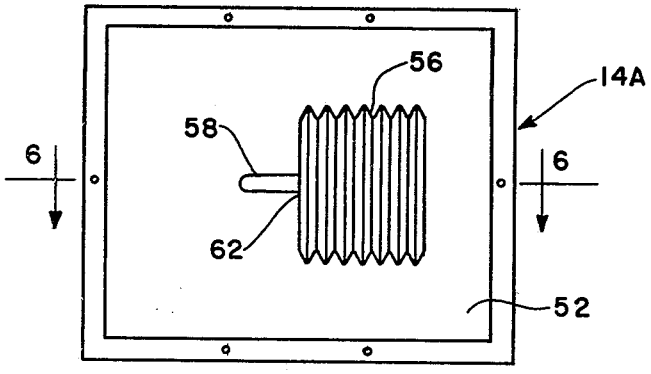
Figure 6:
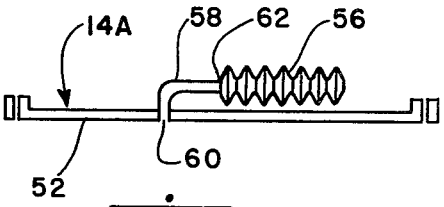

The first closure 14 comprises a frame means 22, an expansible/contractable member 24, and at least one seal member 26. Referring briefly to FIGS. 3 and 4, the frame means 22 consists essentially of an outer peripheral frame member 28 and one or more longitudinal and/or transverse structural members 30. A plurality of alignment holes 32 are provided in the outer frame member 28. The frame means 22 may be made of any suitable material, such as metal or a polymeric material, such as polypropylene, ABS, nylon or the like.

The expansible contractable member 24 may be a unitary sheet of a natural or synthetic elastomeric material, or it may be a laminate consisting essentially of alternating layers of a suitable fabric and a suitable natural or synthetic elastomeric material. Suitable elastomeric materials include natural rubber, butyl rubber, nitrile rubber, EPDM and the like. The elastomeric material may be thermoplastic, but preferably is a vulcanized material.

The elastomeric member 24 is either embedded in the frame means 22, as illustrated in FIG. 2, or it may be suitably attached thereto.

Referring again to FIGS. 1 and 2, the first closure 14 is interposed between the box 12 and lid 16. It is presently preferred to incorporate a first seal member 26 between the box 12 and closure 14 and a second seal member 27 between the closure 14 and lid 16. The seal members 26 and 27 are made of a suitable material, such as a natural or synthetic elastomeric material.

The box 12 is provided with a plurality of outwardly extending alignment pins 34. The positions of the alignment holes 32 in the frame means 22 correspond to the locations of pins 34 in box 12. The lid 16 is provided with correspondingly located alignment holes 36.

The box 12 may be a single-wall or multi-wall, as illustrated, with an inner wall 38, an outer wall 40 and a layer of insulation 42 therebetween. The inner wall 38 and outer wall 40 may be made of any suitable material, such as polypropylene, ABS, polyamide, polyimide, reinforced epoxy resin, reinforced polyester resin, or the like, or preferably, of metal, as illustrated. The lid 16 is similarly constructed.

The lid 16 has an overhanging lip 44 which may be an integral part of lid 16, or separately attached, for engaging and providing protection for the top outer peripheral surface of box 12.

The box 12 and lid 16 may be joined together with a plurality of latching devices 45.

The box 12 is provided with an indicator device 46 in communication with chamber 18 for indicating the presence of certain vapors or the approximate level of vapors within the chamber 18. The device 46 may, for example, be a moisture indicator for indicating the presence of water vapor within chamber 18 above a desired relative humidity. Suitable moisture indicating materials are well known in the art.

Box 12 may be provided with a pressure gauge 47 for indicating the pressure within chamber 18. Box 12 is provided with a manual pressure equalizing valve 48 for equalizing the pressure within chamber 18 with ambient pressure prior to opening container 10.

The lid 16 is provided with pressure equalizing means 50 for equalizing the pressure within chamber 20 with ambient pressure. The means 50 may be a small bleed orifice for controlled, slow equalization of pressure, or it may be an automatic pressure valve which provides controlled equalization of pressure in either direction.

Two other embodiments of the first closure 14 are illustrated in FIGS. 5–8, and are designated by the reference numerals 14A and 14B. The closure 14A, shown in FIGS. 5 and 6, comprises a support member 52, a bellows device 56, and conduit means 58 having one end 60 in communication with chamber 18 when the closure 14A is operatively associated with box 12, and the other end 62 of conduit 58 in communication with bellows 56. The support member 52 is made of any suitable material. The bellows device 56 is made of any suitable material, such as a rubberized fabric.

Figure 7:
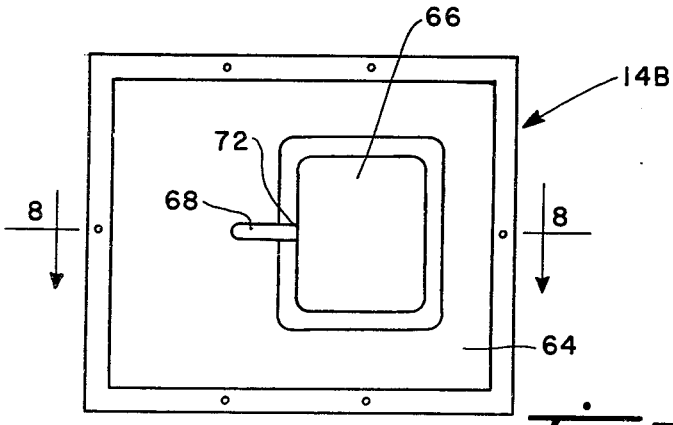
Figure 8:
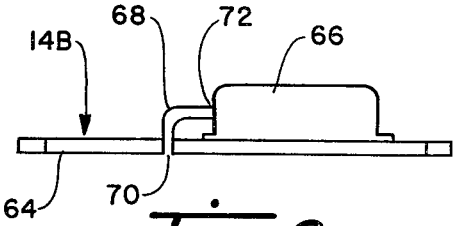

The closure 14B, shown in FIGS. 7 and 8, comprises a support member 64, a bladder device 66 and conduit means 68 having one end 70 in communication with chamber 18 when the closure 14A is operatively associated with box 13, and the other end 72 in communication with bladder 66. The support member 64 is made of any suitable material. The bladder device 66 is made of any suitable material, such as natural or synthetic rubber.

The container 10 of the present invention is particularly well suited for shipping and storing articles which are impractical to shrink wrap and materials which are corrosive or present a health hazard. The container 10 allows for expansion/contraction of the atmosphere within the chamber 18 yet does not permit an exchange of this atmosphere with the surrounding atmosphere.

Various modifications to the above-described invention will be apparent to those skilled in the art.

I claim:

1. A shipping and storage container comprising a box having an open top, a lid for said box, and a closure interposed between said box and said lid, said box and said closure defining a first chamber adapted for containing at least one item, and said lid and said closure defining a second chamber; said closure comprising a frame means, an expansible/contractable member in operable communication with said first chamber to allow expansion/contraction of the atmosphere within said first chamber, and at least one seal member adapted to provide sealing relation between said closure and said box; means for equalizing the pressure of said atmosphere within said first chamber with ambient pressure external to said chamber; means for equalizing the pressure within said second chamber with ambient pressure external to said container; said box being provided with a plurality of alignment pins, and said lid and said closure frame means each having a plurality of alignment holes in corresponding location to said alignment pins; said lid having an overhanging lip for engaging and providing protection for the top outer peripheral surface of said box; and a plurality of latching devices for joining together said box and said lid.

2. The container of claim 1 further comprising means for indicating the presence of undesirable vapors in the atmosphere within said first chamber.

3. The container of claim 1 wherein said expansible/-contractable member is an elastomeric sheet.

4. The container of claim 1 wherein said expansible/-contractable member comprises a bellows.

5. The container of claim 1 wherein said expansible/-contractable member comprises a bladder.

* * * * *